United States Patent [19]

Ito et al.

[11] 4,270,449

[45] Jun. 2, 1981

[54] METHOD OF PRINTING PLASTIC SURFACES

[75] Inventors: Yoshiyashu Ito, Yono; Takeo Sugiura, Tokorozawa; Yoshikatsu Sawada, Tokyo, all of Japan

[73] Assignee: Toppan Printing Co., Ltd., Tokyo, Japan

[21] Appl. No.: 12,079

[22] Filed: Feb. 14, 1979

[30] Foreign Application Priority Data

| | | | |
|---|---|---|---|
| Mar. 2, 1978 | [JP] | Japan | 53-23731 |
| Oct. 3, 1978 | [JP] | Japan | 53-121684 |
| Oct. 3, 1978 | [JP] | Japan | 53-121685 |
| Oct. 12, 1978 | [JP] | Japan | 53-125543 |
| Dec. 29, 1978 | [JP] | Japan | 53-162102 |

[51] Int. Cl.[3] ..... G03G 13/14; B41M 7/00

[52] U.S. Cl. ..... 101/129; 250/318; 355/3 FU; 355/14 FU; 427/145; 101/170; 101/426; 430/98; 430/307; 430/309

[58] Field of Search ..... 101/170, 426, 1 R, DIG. 13, 101/129–130; 250/316.1, 317.1, 318–319, 330; 219/216; 427/55–56.1, 348, 146, 378, 145; 355/3 FU, 14 TR, 14 FU; 315/200 R; 430/98, 328, 300, 30 G, 309

[56] References Cited

U.S. PATENT DOCUMENTS

| | | | |
|---|---|---|---|
| 3,103,881 | 9/1963 | Grieshaber | 250/318 X |
| 3,445,626 | 5/1969 | Michaels | 250/317.1 X |
| 3,474,223 | 10/1969 | Leiga et al. | 219/216 |
| 3,694,245 | 9/1972 | Anderson et al. | 250/318 X |
| 3,904,875 | 9/1975 | Rees et al. | 250/317.1 X |
| 3,911,171 | 10/1975 | Janssens et al. | 427/145 |
| 3,965,282 | 6/1976 | Janssens et al. | 250/330 X |
| 4,001,541 | 1/1977 | Hatch et al. | 219/216 |
| 4,060,382 | 11/1977 | Vertegaal | 250/318 X |

FOREIGN PATENT DOCUMENTS

| | | | |
|---|---|---|---|
| 1284542 | 8/1972 | United Kingdom | 250/318 |

*Primary Examiner*—E. H. Eickholt

*Attorney, Agent, or Firm*—Bacon & Thomas

[57] ABSTRACT

A plastic surface-printing method which comprises the steps of drawing an image on a plastic surface by an ink composition containing a coloring material; enclosing the printed plastic surface in a cover wherein there is placed a flash discharge tube; causing the flash discharge tube to emit light beams to irradiate heat pulses on the printed plastic surface; applying pressure on the printed plastic surface due to the expansion of air in the cover resulting from the application of heat pulses; and fixing an inked image on the plastic surface.

16 Claims, 5 Drawing Figures

METHOD OF PRINTING PLASTIC SURFACES

This invention relates to a method of printing a plastic material, for example, plastic moldings, plastic sheets, and plastic films formed, on paper sheets, metals, wood pieces and any other materials.

The prior art method of coloring or dyeing a plastic material, for example, plastic moldings, plastic sheets, and plastic films formed on paper sheets, metals, wood pieces and any other materials is to adhere an ink composition to a plastic material being printed or dissolve or disperse a coloring material in the plastic material itself at the time of molding. The former deposition process has the drawbacks that the various properties of an ink composition are deteriorated due to deposition, making it necessary to apply a protective coating on the deposited ink composition. The latter dissolution or dispersion process also has the drawbacks that since a coloring material is dissolved or dispersed in, for example, a plastic material before molded, not only are difficulties presented in applying multi-coloring materials, but also heavy losses of the coloring material result.

It is accordingly the object of this invention to provide a novel method of printing a plastic surface which is saved from the above-mentioned difficulties accompanying the prior art plastic surface-printing process. The plastic surface-printing method of this invention comprises the steps of forming an image on a plastic surface by an ink composition containing a coloring material; enclosing the image-impressed plastic surface in a cover where placed a flash discharge tube; causing the flash discharge tube to emit light beams; and applying heat pulses, that is, directly issued and reflected heat pulses to the plastic surface by effectively utilizing pneumatic pressure caused by the expansion of air in the cover resulting from application of heat pulses, thereby fixing the inked image on the plastic surface.

This invention can be more fully understood from the following detailed description when taken in conjunction with the accompanying drawings, in which:

FIGS. 1 and 4 indicate a heat pulse generator used with this invention;

Figure 1:
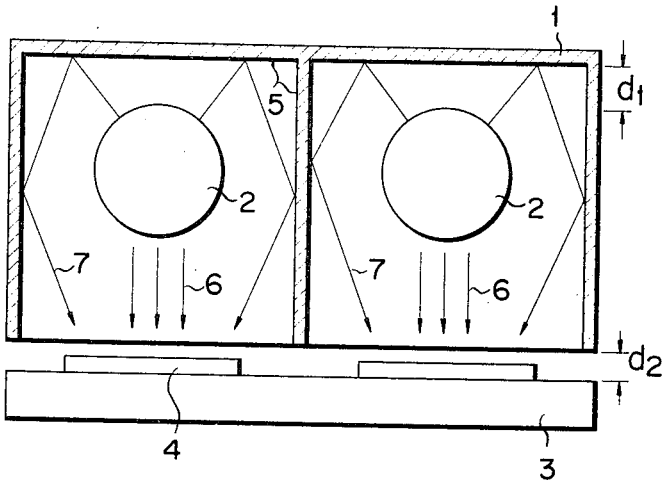

As shown in FIG. 1, light beams are emitted from flash discharge tubes 2 placed in a cover 1 to apply heat pulses to an inked image 4 drawn on the surface of plastic board 3. For irradiation of as much heat as possible, it is preferred to effectively converge heat rays (indicated by arrows 6) directly emitted from the flash discharge tube 2 and heat rays (indicated by arrows 7) reflected from the inner walls of the cover 1 on the inked image 4. To this end, it is necessary to set the flash discharge tube 2 as close as possible to the inner wall of that side of the cover 1 which faces the inked image 4, that is, to reduce a distance $\alpha_1$ between the flash discharge tube 2 and said inner wall of the cover 1, and mount reflector 5 on said inner wall to collect as much reflected heat rays as possible. In this case, the reflector 5 and said inner wall of the cover 1 should preferably be of such material and color as ensure the largest possible reflection of heat rays. Further, it is necessary to decrease as much as possible a distance $\alpha_2$ between the lower end portion of the cover 1 and the surface of the plastic board 3 in order to effectively apply the pressure of air expanded in the cover 1 due to application of heat pulses on to the inked image. Moreover, the inner volume of the cover 1 has to be reduced as much as possible to increase the pressure of heat-expanded air.

This invention relates to a method of fixing an image printed a plastic surface by applying a heat pulse generator whose flash discharge tube 2 is made to emit light beams.

Coloring materials usable with this invention are pigments, dyestuffs and mixtures thereof. Practically preferred are dyestuffs permeable to heat. Commonly used sublimable dyestuffs belong to this category. Available for this invention are various dyestuffs such general dispersion types and oil-soluble types. As indicated by trademarks, the usable dyestuffs include Sumikaron Violet 3BL, Sumikaron Yellow-E-FG, Sumikaron Orange E-G, Sumikaron Violet RL, and Sumikaron Blue E-E BL (all manufactured by Sumitomo Kagaku Kogyo K.K.); Diacelliton Fast Violet B, Dianix Yellow 5 R-E, Dianix Red R-E, Dianix Brilliant Red BS-E, and Dianix Navy Blue ER-FS (all manufactured by Mitsubishi Kasei K.K.); Miketon Fast Scarlet B, and Miketon Polyester Red FB (all manufactured by Mitsui Toatsu K.K.); Kayaset Blue FR (manufactured by Nippon Kayaku K.K.); Mihara Oil Yellow 5G, Mihara Oil Orange G, Mihara Oil Change R, Mihara Oil Red 5B, and Mihara Oil Green AX (all manufactured by Mihara KaKo K.K.); and Oil Yellow G and Oil Black FBB (all manufactured by Toyo Ink Seizo K.K.).

Pigments used with this invention include inorganic pigments such as carbon black, acetylene black, chrome yellow, cadmium yellow iron oxide, rouge, minium, cobalt purple, ultramarine, Prussian blue, chrome green, chromium oxide, and zinc white; and organic pigments such as Cyanine Black BX, Hanse Yellow G, Pigment Yellow L, Permanent Orange, Fire Red, Rhodamine Lake B, Methyl Violet Lake, Phthalocyanine Blue, Indigo and Pigment Green B.

The above-mentioned dyestuffs available for this invention as ink-coloring materials are mixed and kneaded with an organic solvent to provide a required ink composition. The usable organic solvents include alcohols such as methanol, ethanol, propyl alcohol, ethylene glycol, diethylene glycol, polyethylene glycol and glycerin; ethers such as isopropyl ether, ethylene glycol monomethyl ether, ethylene glycol monobutyl ether, diethylene glycol monomethyl ether, and diethylene glycol monobutyl ether; and ketones such as acotone, methylethyl ketone, cyclohexanone and acetophenone.

Where the above-mentioned pigments or mixtures thereof with the dyestuffs are used as ink coloring materials, then a required ink composition can be prepared by mixing and kneading together the pigments or mixtures thereof with the dyestuffs, organic solvents and resins soluble in said organic solvents. The usable resins include natural resins such as copal, dammar gum, rosin, and shellac; hydrocarbon resins such as polyethylene, polypropylene, polystyrene and polyisobutylene; vinyl series resins such as polyvinyl acetate, polyvinyl chloride and copolymers of polyvinyl acetate and polyvinyl chloride; acrylic resins such as methyl acrylate, and methyl methacrylate; rubber derivatives such as butyral resin, epoxy resin, chloride rubber, and cydized rubber; synthetic resins like initial condensates of thermosetting resins such as phenol formaldehyde; cellulose derivatives such as nitrocellulose and acetylcellulose; and mixtures of two or more of the above-listed compounds. The organic solvents for dissolving the above-mentioned resins include tarry solvents, alcohols, esters, ketones and glycol ethers. The tarry solvents include benzene, toluene and xylene. The alcohols include methanol and butyl alcohol. The esters include ethyl acetate, amyl acetate, glycol acetate and monomethyl ether. The ketones include, acetone, methyethyl ketone and cyclohexanone. The glycol ethers include glycol monomethyl ether and glycol monoethyl ether. The organic solvents should be selected according to the type of resin used. It is generally advised to use alcohols and ketones with the natural resins; tarry solvents, ketones and esters with synthetic resins; alcohols and esters particularly with initial condensates of thermosetting resins; and tarry solvents, alkols, ketones and esters with cellulose derivatives. It is possible to apply the above-listed organic solvents alone or in combination.

The undermentioned additives may be added to an ink composition usable with this invention in order to elevate its properties. For instance, addition of infrared absorbent increases the absorption of heat produced by heat pulses. In this case, the desired object is attained by applying heat pulses having a smaller amount of energy than when an ink composition does not include said infrared absorbent. For the object of this invention, it is possible to use an infrared absorbent having either of the following structural formulas (I) and (II):

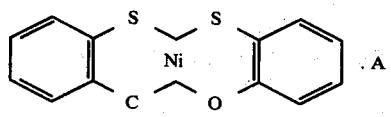

(I)

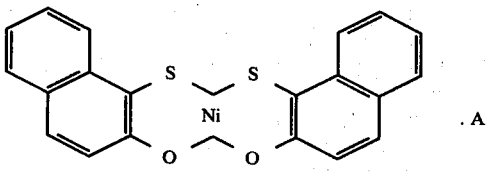

(II)

The character A given in the above formulas (I) and (II) denote a quarternary ammonium radical to the formula (I), bis (1-thio-2-phenolate) nickel-tetrabutyl ammonium in which the character A denotes tetrabutyl ammonium salt is expressed by the following structural formula (II). Referring to the formula (II), bis (1-thio-2-naphtholate) nickel-tetrabutyl ammonium in which the character A represents tetrabutyl ammonium salt is expressed by the following structural formula (IV).

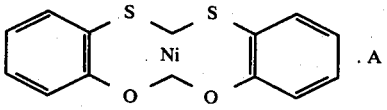

(I)

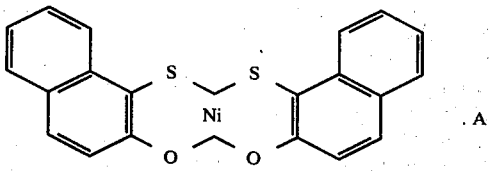

(II)

bis (1-thio-2-naphtholate) nickel-tetrabutyl ammonium given in the formula (IV) has a maximum infrared-absorbing property at the waavelengths of 730 nm, 1110 nm, and 1370 nm, and can absorb near-infrared rays over a broad wavelength range from 1000 nm to 1600 nm. It is preferred to apply 1 to 20% by weight of these infrared absorbents on the basis of a coloring material contained in an ink composition in consideration of not only the effect of fixing an ink composition by addition of said infrared absorbents, but also the prevention of changes in the hues of the ink composition and associated economic factors, other infrared absorbents include N-tetraphenyl-benzoquinone-diimmonium salts. Particularly preferred is the salt expressed by the following general structural formula (V):

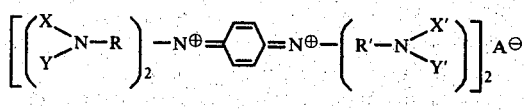

(V)

Where:

X.X', Y.Y'=alkyl radicals having 6 carbon atoms at maximum

R, R'=substituent or nonsubstituent benzene radical

A=anion, if any. The anion includes nitrates of chlorides, chlorates, sulfates, sulfonates, hexafluoro arsenate and hexafluoro antimonate.

Fluorenol which also absorbs infrared rays is expressed by the following general structural formula (VI):

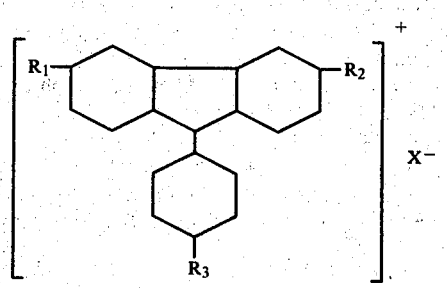

(VI)

where:

R1, R2, R3=hydrogen atom, $-O_nH_{2n+1}$ (n denotes a number of 1 to 6), or amino radical. At least two of these radicals R1, R2, R3 represent amine radicals.

X=anion, if any

One, or more hydrogen atoms can be substituted by substituent radicals such as alkoxy, alkyl, chlorine, bromine fluorine, nitro, acyl, acylamid, and sulfonamide. Other infrared absorbents an ferrous or ferric chelate compounds of O-quinone monooxym. These chelate compounds indude ferrous 2-naphtho quinone oximate, ferrous 6-bromo-1, 2-naphtho-quinone oximate, ferrous 3, 5-hydroxy (or 3, 5-7'-hydroxy)-naphtho-quinone oximate, and another form of ferrous oximate in which 0.5 to 0.2 mols of dinitroso resorcin are contained per mol of 1-nitroso-2-naphthol. Other preferred infrared absorbents are N, N, N', N'-tetrakis (P-substituted phenyl)-P-phenylene diamines, benzidines, and aluminium salts and diimmonium salts of said benxidines. The last mentioned group of infrared absorbents is expressed by the following general structural formula (VII):

(VII)

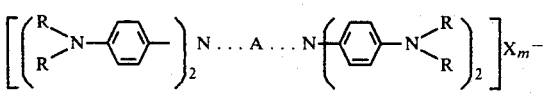

where:

R=hydrogen or lower alkyl radical

X=anion selected from the group consisting of hexafluoroarsenate ion, hexafluoroantimonate ion, fluoroboric acid ion and perchloric acid ion.

m=integer of 0, 1 or 2

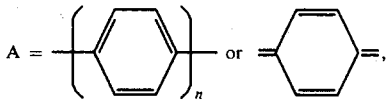

in case m is 2 n=integer of 1 or 2

As apparent from the object of this invention, usable infrared absorbents are not limited to those above listed. For instance, carbon black and ion oxide used as a coloring material in this invention also function as an infrared absorbent. Application of a mixture of infrared absorbents and coloring materials concurrently acting as infrared absorbents displays a good effect. A plasticizer is added to an ink composition to elevate the flexibility of an ink film, the adhesivity of the ink film to a plastic surface and the self-supporting property of the ink film. Such plasticizer includes esters of dibasic acids, higher aliphatic acids, aromatic acids and phosphoric acid and esters of polyhydric alcohols. Further, an interfacial active agent is added to a coloring material to improve its dispersibility and wettability. Such interfacial active agent includes aliphatic acids, other organic acids, metal salts thereof, oxyacids and derivatives thereof, and sulfonic acid compounds. Moreover, an antifoaming agent is added to an ink composition to remove bubbles therefrom. Such antifoaming agent includes silicone compounds.

The method of drawing an image by an ink composition containing a coloring material on a plastic surface includes direct printing and transfer printing. The direct printing can be effected by relief printing, dry offset printing, flexographic printing, intaglio offset printing, gravure offset printing and silk screen printing. If made with as low hardness as possible, a blanket used with the dry offset printing, integlio offset printing and gravure offset printing can ensure the good transfer of an ink composition and consequently provide a distinct impression. The transfer printing method includes the process of previously printing an image on a transfer sheet and transfering the printed image on a plastic surface at low temperature and pressure, and the process of previously spreading an ink composition over a transfer sheet or previously impregnating said sheet with the ink composition and transfering an impression by pressing a desired relief plate on a plastic surface at low temperature and pressure. A sheet used for transfering of an inked image includes a film prepared from polyester, cellophane, polyethylene, polypropylene, polyvinyl chloride, polyvinylidene chloride, polystyrene, polyamide, polycarbonate and acetate, a sheet of paper coated with such film, laminates thereof and metal sheets of steel or aluminium. A transfer sheet further includes fabric and paper. Transfer is generally carried out at room temperature, and a pressure of 5 to 20 kg/cm$^2$ for 0.5 to 2 seconds.

Figure 2:
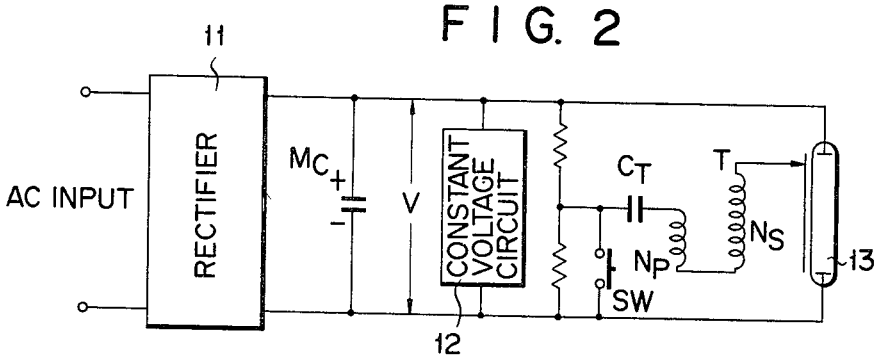
FIG. 2 illustrates the principle by which a flash discharge tube emits light beams.

An inked image formed by the aforesaid processes is firmly set on a plastic surface by irradiating thereon heat pulses issued from a heat pulse generator. Heat pulses are produced by the undermentioned principle. Referring to FIG. 2, electric energy is charged in a main capacitor MC from an AC input terminal through a voltage stepup rectifier 11. Later when a switch SW is short-circuited, electric charge stored in a capacitor CT is conducted to the prinary winding NP of a trigger coil T. (Reference numeral 12 denotes a constant voltage circuit.) Since the secondary winding NS of the trigger coil T has a for larger winding ratio than the prinary winding NP of said trigger coil T, a high voltage is generated in said secondary winding NS. The high voltage is impressed on a third electrode wound about a flash discharge tube 13 in which a rare gas is sealed. The rare gas of the flash discharge tube 13 is ionized to create an electric circuit therein. Electric charge stored in the main capacitor MC is instantly discharged to issue heat pulses. The energy of the heat pulses is expressed by the following formula:

$$E=\frac{1}{2}CV^2$$

where:

C=capacity ($\mu$F) of the main capacitor

V=terminal voltage (V) of the main capacitor

Figure 3:
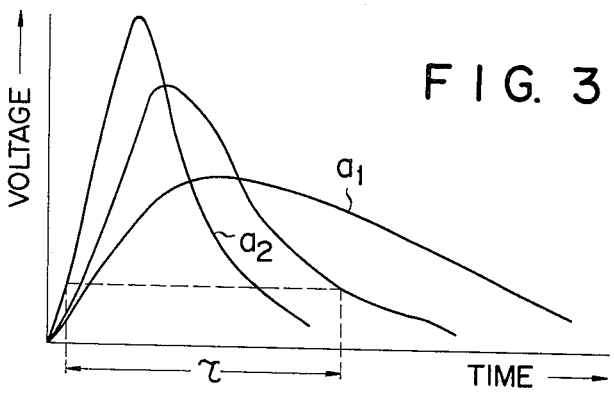
FIG. 3 is a graph showing the waveforms of heat pulses resulting from light emission by the flash discharge tube.

Xenon gas, sealed in the flash discharge tube 13 produces heat pulses having a higher heat-generating efficiency than other rare gases such as neon, argon and krypton. The waveforms of heat pulses can generally be illustrated as in FIG. 3.

A period $\tau$, so called "Duration", during which a heat pulse is sustained (a length of time arrived at by subtracting a length of time required for 20% of a heat pulse to begin to rise from a length of time required for 80% of the heat pulse to begin to fall) is defined by such factors as the capacitor C and terminal voltage V of the main condenser MC and the impedance of the flash discharge tube 13. Where, with an amount of energy produced by heat pulses assumed to be fixed, the main capacitor MC increases in capacity and the terminal voltage V thereof is reduced, then the peak value of the waveform of the heat pulse falls and the duration of the peak pulse tends to be extended as seen from the curve $a_1$. With an amount of energy produced by heat pulses assumed to be fixed, as the capacity of the main capasitor MC is made smaller, and the terminal voltage thereof gets higher, the peak value of the waveform of the heat pulse rises and the duration tends to be reduced (curve $a_2$).

Observation was made of the condition in which the images were fixed appling to out invention on various types of plastic surfaces by different ink composition. Where a flash discharge tube was used in which an arc had a length of 320 mm and whose diameter was 12 mm, and a distance D2 between the lower end portion of the cover 1 and the surface D of a plastic material was chosen to be 10 mm, then it was experimentally found that the undermentioned conditions produced an optimum fixed image. Namely, the image-fixing conditions were defined by the duration of a heat pulse and the magnitude of energy generated thereby. The former fuctor depends on an ink composition, and the latter fuctor is governed by the hue of the ink composition and the properties of a plastic material whose surface is to be impressed with an image.

There is now given a concrete description of the plastic surface-printing method of this invention. It is possible to use an ink composition consisting of dyestuffs, an ink composition formed of a mixture of dyestuffs and pigments and an ink composition prepared from pigments alone with resins whose glass transition temperature is higher than the room temperature, such as polyamide resin, acrylic resin, polycarbonate resin, polyacetal resin, polyimide resin and polyphenylene sulfide resin. With an ink composition formed of dyestuffs, about 1600 Ws are considered optimum as the heat-generating efficiency of heat pulses, and 1/50 to 1/70 sec is regarded as optimum as the duration of a heat pulse. With an ink composition prepared from a mixture of dyestuffs and pigments and pigments alone, the heat-generating efficiency of heat pulses is preferred to be about 1700 Ws, and the duration of a heat pulse is desired to be 1/90 to 1/110 sec. Among the above-mentioned group of resins, those which contain, for example, a plasticizer, such as polyvinyl chloride resin, or those which contain a large amount of amorphous portions such as ABS resin and polystyrene resin, enable an inked image to be well fixed in the aforesaid duration by irradiation of heat pulses having a smaller amount of heat energy than when the resins belonging to the previously described group are used. With the plastic materials whose glass transition temperature is lower than the room temperature, such as olefinic resins, for example, polyethylene, and copolymers of polyethylene and polyvinyl acetate, it is advised to apply an ink composition consisting of pigments alone. In this case, 1500 Ws is considered optimum as the heat-generating efficiency of heat pulse, and 1/90 to 1/110 sec is regared as desirable as the duration of a heat pulse. Where an image is impressed by an ink composition consisting of dyestuffs on the surface of a plastic material whose glass transition temperature is lower than the room temperature, and heat pulses are irradiated on said surface, than it has been experimentally found that dyestuffs excessively disperse through the resin and bleed, presenting difficulties in providing a clear image. Where blue and red ink compositions are applied, an inked image can be satisfactorily fixed by irradiating heat pulses having a higher heat-generating efficiency than when a black ink composition is used.

This invention is applicable to various forms of resin by controlling an amount of heat energy generated by heat pulses. The resins usable with this invention include rubbers, elastomers such as polyester elastomer and polyurethane elastomer, polyolefinic resins such as polyethylene, and copolymers of polyethylene and polyvinyl acetate, polyvinyl chloride resin, polyamide resin, polyester resin, ABS resin, acrylic resin, polyacetal resin, polycarbonate resin, polyimide resin, and polyphenylene sulfide resin.

The printing method of this invention is further applicable to not only plastic moldings such as plastic boards, plastic containers, and plastic sheets, but also plastic films spread or coated on, for example, paper sheets, metals and wood pieces.

As mentioned above, the inked image-fixing method of this invention consists in applying heat and pneumetic pressure to a plastic surface by heat pulses to fix an inked image instantly, thereby preventing a printed plastic material from being deformed by heat applied for fixation of an inked image. When an inked image is fixed by heat and pneumatic pressure according to this invention, dyestuffs constituting an ink composition permeates into a plastic material, and pigments constituting an ink composition are thrust in a plastic surface. Further, in the case of the later, the plastic surface is coated with an ink film which is made flexible and adhesive by addition of, for example, a resinous material to an ink composition. Therefore, it is possible to impress a plastic surface with an inked image having prominent resistance to abrasion, chemicals and light beams.

This invention will be more fully understood by reference to the examples which follow.

EXAMPLE 1

Figure 4:
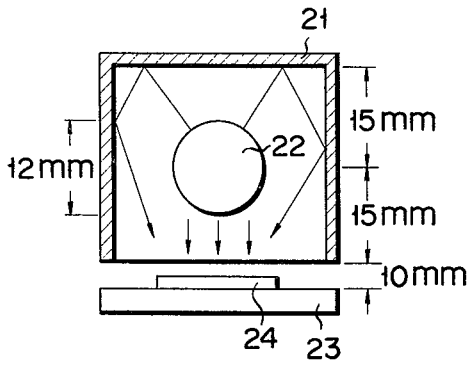

An ink composition was used which was prepared by mixing and kneading 60 parts by weight of Diacelliton Violet B (a dyestuff manufactured by Mitsubishi Kasei K.K.) and 50 parts by weight of polyethylene glycol (molecular weight 200). An inked image 24 was formed, as shown in FIG. 4, by dry offset printing on an acrylic resin board 2 mm thick (manufactured by Mitsubishi Rayon K.K.). Heat pulses were irradiated on the surface of the acrylic resin board 23 from a flash discharge tube 22 in which an arc had a length of 320 mm, and whose diameter was 12 mm. At this time the duration of a heat pulse was set at 1/65 sec. The heat-generating efficiency of heat pulses was chosen to be 1732 Ws (the capacity of the main capacitor MC was taken to be 13,425 $\mu$F and the terminal voltage there of was set at 508 V). The distance between the lower end portion of the cover 21 and the surface of the acrylic resin board 23 was set at 10 mm. Then a clear permeated image was instantly fixed without deforming the acrylic resin board. The permeated image was prominently resistant to chemicals such as alcohols and benzene. Further images fixed on the acrylic resin boad were abraded more than 1000 times with said images each other under a load of 1 kg by a Sutherland Ink Rub Tester (manufactured by Toyo Seiki Seisakusho). None of the images presented a change.

EXAMPLE 2

3 parts by weight (5% by weight based on a dyestuff) of bis (1-thio-2-naphtholate) nickel-tetrabutyl ammonium were added (followed by kneading) as an infrared absorbent to an ink composition consisting of the same components as in Example 1. An image was impressed by dry offset printing on the same acrylic resin board as used in Example 1. Heat pulses were irradiated on the surface of the acrylic board from the same type of heat pulse generator as applied in Example 1. At this time, the duration of a heat pulse was set at 1/65 sec. The heat-generating efficiency of heat pulses was chosen to be 1638 Ws (the capacity of the main capacitor MC was taken to be 13,425 $\mu$F, and the terminal voltage thereof was set at 494V). The distance between the lower end portion of the aluminum board cover and the surface of the acrylic resin board was set at 10 mm. Then a clear image was instantly fixed with the same abrasion resistance as indicated in Example 1, without deforming the printed acrylic resin board.

EXAMPLE 3

A denatured resin was produced by reacting 10% by weight of the initial condensate of resol type phenol formaldehyde with 90% by weight of a thermally copolymerized compound consisting of 85% by weight of dicyclopentadiene and 15% by weight of 1, 3-pentadiene. This denatured resin was further denatured by adding 50 parts by weighty of linseed oil. 15 parts by weight of carbon black having a particle size of 230 microns were mixed (followed by kneading) as a coloring material with 100 parts by weight of a vehicle prepared by dissolving the last-mentioned denatured resin in 150 parts by weight of a solvent #3. An image was drawn by the silk screen printing process on a high density (0.96) polyethylene board 3 mm thick (manufactured by Showa Yuka K.K.), using an ink composition prepared as described above. Heat pulses were irradiated on the surface of the high density polyethylene board from the same type of heat pulse generator as used in Example 1. At this time, the duration of a heat pulse was set at 1/95 sec. The heat-generating efficiency of heat pulses was chosen to be 1470 Ws (the capacity of the main capacitor MC was taken to be 9398 μF, and the terminal voltage thereof was set at 560V). The distance between the lower end portion of the aluminium board cover and the surface of the high density polyeethylene board was taken to be 10 mm. Then a clear image was instantly fixed with the same abrasion resistance as indicated in Example 1, without deforming the printed high density polyethylene board.

EXAMPLE 4

An image was drawn by the flexographic printing process on the surface of an ABS resin board 2 mm thick (manufactured by MITSUBISHI MONSANTO K.K.), using an ink material having the following composition:

| | Parts by weight |
|---|---|
| Prussian blue (particle size: 200 microns) | 6 |
| Kayaset Blue FR (manufactured by NIHON KAYAKU K. K.) | 2 |
| Nitrocellulose | 15 |
| Alkyd resin | 15 |
| Dibutyl phthalate | 6 |
| Amyl acetate | 12 |
| Methylethyl ketone | 38 |
| Xylene | 6 |
| | 100 |

Heat pulses were irradiated on the surface of the ABS resin board from the same type of heat pulse generator as used in Example 1. At this time, the duration of a heat pulse was set at 1/95 sec. The heat-generating efficiency of heat pulses was taken to be 1635 Ws (the capacity of the main capacitor MC was chosen to be 9398 μF, and the terminal voltage thereof was set at 590V). The distance between the lower end portion of the aluminium board cover and the surface of the ABS resin board was taken to be 10 mm. Then a clear image was instantly fixed with the same abrasion resistance as shown in Example 1, without deforming the printed ABS resin board.

EXAMPLE 5

An image was impressed by the relief printing process on the surface of a nylon 6/6 resin board 2 mm thick (manufactured by Daicel K.K.), using an ink material which had the same composition as in Example 4 and was further mixed and kneaded with 1 part by weight of polyethylene wax as an additive. Heat pulses were irradiated on the surface of the nylon 6/6 resin board from the same type of heat pulse generator as used in Example 1. At this time, the duration of a heat pulse was set at 1/95 sec. The heat-generating efficiency of heat pulses was set at 1732 Ws (the capacity of the main capacitor MC was 9398 μF, and the terminal voltage thereof was 608V). Then a clear image was instantly fixed with the same abrasion resistance as displayed in Example 1, without deforming the nylon 6/6 resin board.

EXAMPLE 6

An image was drawn by the flexographic printing process on the surface of a steel sheet, using an ink composition prepared by mixing and kneading 60 parts by weight of Dianix Brillian Red BS-E (manufactured by Mitsubishi Kasei K.K.) and 50 parts by weight of diethylene glycol monobutyl ether. The image was transfered on a magnetic credit card prepared from white hardenable vinyl chloride at a temperature of 60° C. and a pressure of 15 kg/cm$^2$. Heat pulses were irradiated on the credit card from the same type of heat pulse generator as used in Example 1. At this time, the duration of a heat pulse was set at 1/65 sec. The heat-generating efficiency of heat pulses was chosen to be 1732 Ws (the capacity of the main capacitor MC was taken to be 13,425 μF, and the terminal voltage thereof was set at 508V). The distance between the lower end portion of the aluminium board cover and the surface of the credit card was set at 10 mm. Then a clear image was immediately fixed with the same abrasion resistance as shown in Example 1. At this time, the magnetic credit card fully met the required dimensional precision. Where an indication on the surface of the credit card was read 5000 times by an electronic reader no change appeared in said indication.

EXAMPLE 7

An image was drawn by the gravure printing process on a sheet of paper which was coated with a film of polyester resin (manufactured by Toyo Rayon K. K.) to a thickness of 50 microns, using an ink composition prepared by mixing and kneading together 10 parts by weight of Sumikaron Violet 3 BL (Sumitomo Kagaku K. K.), 50 parts by weight of methylethyl ketone and 50 parts by weight of toluene. Heat pulses were irradiated on the surface of the coated paper sheet from the same type of heat pulse generator as applied in Example 1. At this time, the duration of a heat pulse was set at 1/65 sec. The heat-generating efficiency of heat pulses was chosen to be 1732 Ws (the capacity of the main capacitor MC was 13,425 μF, and the terminal voltage thereof was 508V). The distance between the lower end portion of the aluminium board cover and the surface of the polyester resin film was taken to be 10 mm. Then a clear image was instantly fixed with the same abrasion resistance as indicated in Example 1, without deforming the impressed paper sheet coated with a film of polyester resin.

EXAMPLE 8

An image was printed on the surface of a polyacetal resin board 3 mm thick (manufactured by Showa Yuka K. K.), using an ink composition prepared by mixing and kneading 60 parts by weight of Kayact Black TD-G (manufactured by Nihon Kayaku K. K.) with 50 parts by weight of polyethylene glycol #200 (molecular weight). Heat pulses were irradiated on the surface of the polyacetal resin board from the same type of heat pulse generator as used in Example 1. At this time, the heat-generating efficiency of heat pulses was chosen to be 1035 Ws. The distance between the lower end portion of the aluminium board cover and the surface of the polyacetal resin board was taken to be 10 mm. Observation was made of the condition in which an impressed image was fixed by varying the duration of a heat pulse. Where the duration was changed within the range of 1/50 to 1/70 sec. then a well-fixed image was produced. Where the duration was increased over the above-mentioned range, it was shown that the drying of the ink composition and the pervasion of the dyestuff thereof through the polyacetal resin board was imperfect, failing to provide a firmly fixed image.

EXAMPLE 9

An image was drawn by the silk screen printing process on the surface of a medical kit catheter prepared by blending 8 parts by weight of polyethylene having a density of 0.958 (manufactured by Nihon Sekiyu Kagaku K. K.) with 2 parts by weight of epichlorohydrin rubber (manufactured by Nihon Zeon K. K.), using the same ink composition as applied in Example 5. Heat pulses were irradiated on the surface of said catheter from the same type of heat pulse generator as used in Example 1. At this time, the distance between the lower end portion of the aluminium board cover and the surface of said catheter was chosen to be 10 mm. The heat-generating efficiency of heat pulses was fixed at 1470 Ws, though the duration of a heat pulse was changed. Observation was made of the fixed state of an inked image under the duration varying condition. It was experimentally found that the duration falling within the range of 1/90 to 1/110 sec. provided a firmly fixed image. In this case, a longer duration led to the less intrusion of the ink composition through the catheter, failing to produce a firmly fixed image. Conversely, a shorter duration resulted in the growth of soot around an image when it was fixed. It was experimentally discovered that in either case, an image could not be firmly fixed.

CONTROL 1

Figure 5:
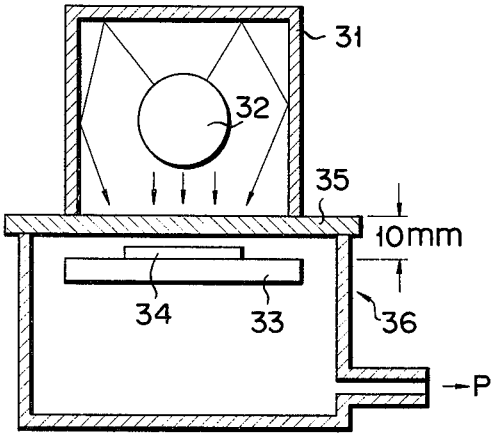
FIG. 5 shows the different condition from this invention in which said heat pulse generator was used in a control intended to indicate the effect of the invention.

An image 34 was drawn by the silk screen printing process on the surface of a plastic board 33 (polyester elastomer), using the same ink composition as used in Example 5. The printed plastic board 33 was placed in an evacuater 36 (FIG. 5) whose top wall was made of glass. The interior of said evacuator 36 was evacuated to a level of 5 mm Hg. Heat pulses were irradiated on the surface of the plastic board 33 from a heat pulse generator whose flash discharge tube 32 has placed in an aluminium cover 31. At this time, the duration of a heat pulse was set at 1/95 sec. The heat-generating efficiency of heat pulses was chosen to be 1470 Ws (the capacity of the main capacitor MC was 9398 $\mu$F, and the terminal voltage thereof was 560V). The distance between the lower end portion of the aluminium board cover 31 and the surface of the polyester elastomer board 33 was set at 10 mm. Then, the pigment of the ink composition was scattered about, and the ink composition did not intrude sufficiently into the polyester elastomer board 33, failing to provide a firmly fixed image. Conversely where the interior of the evacuator 36 was restored to the atmospheric pressure and heat pulses were irradiated on the surface of the polyester elastomer board 33 under the same conditions as described in the foregoing examples, then a clear image was instantly fixed with the same abrasion resistance as shown in Example 1, without deforming the polyester elastomer board 33.

What is claimed is:

1. A method of printing a plastic surface which comprises the steps of drawing an image on the plastic surface, using an ink composition containing a coloring material; enclosing the plastic surface in a cover wherein there is placed a flash discharge tube; causing the flash discharge tube to emit light beams; irradiating heat pulses on the plastic surface; applying pressure to the plastic surface due to the expansion of air in the cover resulting from the application of heat pulses: and firmly fixing the inked image of the plastic surface.

2. The plastic surface-printing method according to claim 1, wherein the ink composition is prepared by dissolving a coloring material consisting of a thermally prevading dyestuff in an organic solvent.

3. The plastic surface-printing method according to claim 1, wherein the ink composition is prepared by dispersing or dissolving a coloring material consisting of an inorganic or organic pigment in a vehicle prepared by dissolving one or more resin compounds selected from the group consisting of natural resins, synthetic resins and cellulose derivative resins.

4. The plastic surface-printing method according to claim 1, wherein the ink composition is prepared by dispersing or dissolving a coloring material consisting of a thermally prevading dyestuff and an inorganic or organic pigment in a vehicle prepared by dissolving one or more resin compounds selected from the group consisting of natural resins, synthetic resins and cellulose derivative resins.

5. The plastic surface-printing method according to any one of claims 1 to 4, wherein the ink composition contains an infrared absorbent.

6. The plastic surface-printing method according to any one of claims 1 to 4, wherein the ink composition contains one or more compounds selected from the group consisting of a plasticizer, interface acting agent and antifoaming agent.

7. The plastic surface-printing method according to claim 1, which draws an inked image by a direct printing process selected from the group consisting of the flexographic printing process, relief printing process, gravure printing process, screen printing process, and intaglio offset printing process.

8. The plastic surface-printing method according to claim 1, which draws an inked image by a transfer printing process.

9. The plastic surface-printing method according to claim 1, wherein the flash discharge tube is a Xenon discharge tube.

10. The plastic surface-printing method according to claim 2, wherein the flash discharge tube is made to emit light beams with the duration of a heat pulse extended.

11. The plastic surface-printing method according to claims 3 or 4, wherein the flash discharge tube is made to emit light beams with the duration of a heat pulse shortened.

12. The plastic surface-printing method according to claim 3, wherein the plastic printed material is prepared from one or more compounds selected from the group consisting of polyolefinic resins and elastomers whose glass transition temperature is lower than the room temperature.

13. The plastic surface-printing method according to claim 1, wherein the plastic printed material is prepared from one or more compounds selected from the group consisting of polyamide resins, polyvinylchloride resins, ABS resins, polyester resins, polyacetal resins, acrylic resins, polyamide resins and polyphenylene sulfide resins, all having a higher glass transition temperature than the room temperature.

14. The plastic surface-printing method according to claim 1, wherein the plastic printed material is a plastic molding.

15. The plastic surface-printing method according to claim 1, wherein the plastic printed material is a plastic sheet.

16. The plastic surface-printing method according to claim 1, wherein the plastic printed material is a plastic film coated on the surface of any desired material.

* * * * *